US012220046B2

(12) United States Patent
Leslie

(10) Patent No.: US 12,220,046 B2
(45) Date of Patent: Feb. 11, 2025

(54) MOUNTABLE HOLDER FOR CONTAINERS

(71) Applicant: Raleigh Leslie, Whitefish, MT (US)

(72) Inventor: Raleigh Leslie, Whitefish, MT (US)

( * ) Notice: Subject to any disclaimer, the term of this patent is extended or adjusted under 35 U.S.C. 154(b) by 196 days.

(21) Appl. No.: 18/116,614

(22) Filed: Mar. 2, 2023

(65) Prior Publication Data

US 2023/0210246 A1 Jul. 6, 2023

Related U.S. Application Data

(60) Provisional application No. 63/295,988, filed on Jan. 3, 2022.

(51) Int. Cl.

| | |
|---|---|
| ***A45F 3/16*** | (2006.01) |
| ***A45F 5/00*** | (2006.01) |
| ***A63C 11/22*** | (2006.01) |
| ***B65D 81/38*** | (2006.01) |

(52) U.S. Cl.

CPC ..... *A45F 5/00* (2013.01); *A63C 11/228* (2013.01); *B65D 81/3876* (2013.01); *A45F 2200/0583* (2013.01)

(58) Field of Classification Search

CPC ..... A45F 3/16; A45F 3/18; A45F 2200/0583; B65D 81/3876; B65D 81/3879; B65D 25/22; Y10S 220/903; Y10S 150/901; A61J 9/08

USPC ..... 224/148.1, 148.4–148.6; 220/903; 150/901

See application file for complete search history.

(56) References Cited

U.S. PATENT DOCUMENTS

| | | | | |
|---|---|---|---|---|
| 1,723,731 A * | 8/1929 | Hafling | A61J 9/08 215/11.1 |
| 4,248,366 A * | 2/1981 | Christiansen | A45F 5/00 220/903 |
| 5,526,924 A * | 6/1996 | Klutznick | A45C 11/043 224/901.2 |
| 5,887,774 A * | 3/1999 | Bethune | B62J 11/04 224/406 |
| D429,117 S * | 8/2000 | Walsh | D7/607 |
| 6,237,820 B1 * | 5/2001 | Saxton | A45F 5/02 D3/229 |

* cited by examiner

*Primary Examiner* — Adam J Waggenspack

(74) *Attorney, Agent, or Firm* — Barry Choobin; Patent 360

(57) ABSTRACT

A mountable holder for carrying a beverage on a supporting structure, such as a ski pole, snowboard, ski shoes, and the like. The mountable holder can safely hold a beverage container and can be coupled to multiple objects. The mountable holder includes an insulative sleeve having multiple pairs of slits in the wall of the sleeve. Dual hook and loop cinch straps pass through the pairs of slits and tighten around the sleeve and the supporting structure for securing the beverage container into the sleeve and the mounting holder to the supporting structure.

12 Claims, 4 Drawing Sheets

MOUNTABLE HOLDER FOR CONTAINERS

CROSS-REFERENCE TO RELATED APPLICATIONS

This application claims priority from a U.S. provisional patent application Ser. No. 63/295,988, filed on Jan. 3, 2022, which is incorporated herein by reference in its entirety.

FIELD OF INVENTION

The present invention relates to a mountable holder for a container, and more particularly, the present invention relates to a sleeve-based mountable holder that can attach to ski poles, snowboard bindings, boots, and like and can hold a beverage.

BACKGROUND

It is common for people to carry a beverage or water while going for sporting activities. However, carrying a can or bottle while doing the activity is tedious. A person may have to hold the beverage container in a hand or pocket while engaging in the activity. Putting the beverage can in a pocket appears very bulgy and is uncomfortable for the person. Carrying the beverage in the backpack is also not comfortable. People may not want to carry a backpack just for the beverage.

A need is therefore appreciated for a device to hold a beverage container to a supporting structure, such as ski poles, snowboard bindings, boots, and the like.

SUMMARY OF THE INVENTION

The principal object of the present invention is therefore directed to a mountable holder for beverage containers that can be mounted to ski poles, snowboard bindings, boots, and the like.

It is another object of the present invention that the beverage container is easily reachable for consumption.

It is still another object of the present invention that the mountable holder is economical to manufacture.

It is a further object of the present invention that the mountable holder can keep the beverage container insulated.

it is still a further object of the present invention that the mountable holder can be quickly mounted and dismounted.

It is yet a further object of the present invention that the mountable holder is compact for storage.

It is an additional object of the present invention that the mountable holder is securely attached to poles and straps.

It is still an additional object of the present invention that multiple mountable holders can be used for carrying several cans.

In one aspect disclosed is a mountable holder comprising: a sleeve having an open top, the sleeve configured to receive a container through the open top; a first pair of slits in an upper portion of a front side of the sleeve; a second pair of slits in a lower portion of the front side of the sleeve; a third pair of slits in an upper portion of a rear side of the sleeve; a fourth pair of slits in a lower portion of the rear side of the sleeve; a first strap having a proximal end and a distal end, the distal end has a first ring, the proximal end passes through the first pair of slits, the third pair of slits, and then loop through the first ring; and a second strap having a proximal end and a distal end, the distal end of the second strap has a second ring, the proximal end of the second strap passes through the second pair of slits, the fourth pair of slits, and then loop through the second ring. Each of the first strap and the second strap has an inner side and an outer side, the inner side is plain, a proximal end portion of the outer side has a first member of a hook and loop fastener, and a rest portion of the outer side has a second member of the hook and loop fastener, wherein the first member is configured to couple with the second member.

In one implementation, the sleeve is made from an insulative material. The sleeve has a surrounding wall and an open bottom, a base strap is coupled at its ends to bottom edges of the surrounding wall. The sleeve is cylindrical in shape.

In one aspect, disclosed is a method comprising: providing a mountable holder comprising: a sleeve having an open top, the sleeve configured to receive the beverage container through the open top, a first pair of slits in an upper portion of a front side of the sleeve, a second pair of slits in a lower portion of the front side of the sleeve, a third pair of slits in an upper portion of a rear side of the sleeve, a fourth pair of slits in a lower portion of the rear side of the sleeve, a first strap having a proximal end and a distal end, the distal end has a first ring, the proximal end passes through the first pair of slits, the third pair of slits, and then loop through the first ring, and a second strap having a proximal end and a distal end, the distal end of the second strap has a second ring, the proximal end of the second strap passes through the second pair of slits, the fourth pair of slits, and then loop through the second ring. The method further comprises putting the beverage container into the sleeve; and mounting the mountable holder to a supporting structure.

These and other objects and advantages of the embodiments herein will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
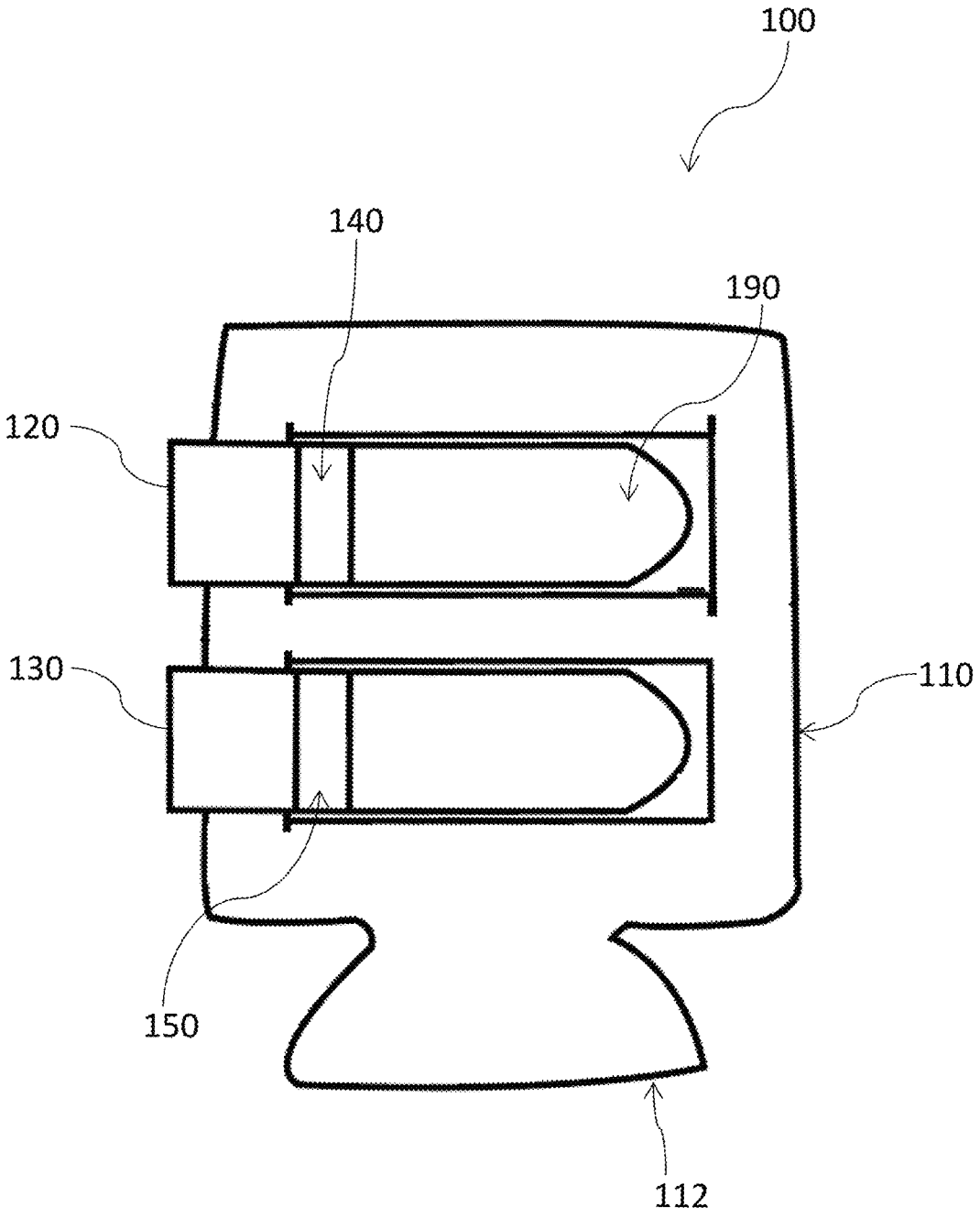
FIG. 1 is a front view of a mountable holder, according to an exemplary embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting to embodiments of the invention. As used herein, the singular forms "a", "an" and "the" are intended to include the plural forms as well, unless the context clearly indicates otherwise. It will be further understood that the terms "comprise", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Disclosed is a mountable holder for beverages, such as a beer can. The disclosed mountable holder can hold the beverage and can be mounted to a supporting structure, such as a pole or a strap. The disclosed mountable holder can include a sleeve into which the container, such as a can of beer can be received. The container in the sleeve can be secured by tightening a strap around the sleeve, the same strap can be used to mount the mountable holder to the supporting structure. The strap can be a dual hook and loop cinch strap. In a preferred embodiment, the disclosed mountable holder can be used to carry beer cans. For example, skiers and riders can carry beer cans mounted to snowboard bindings, ski poles, and ski boot buckles using the disclosed mountable holder. It is understood, however, that the disclosed mountable holder can be used to carry any container. There may be enough room for receiving containers of varied sizes, however, the sleeve of the mountable holder can be provided in different sizes. For example, the disclosed mountable holder can hold a regular-size beer can of 12 oz and 16 oz.

Figure 2:
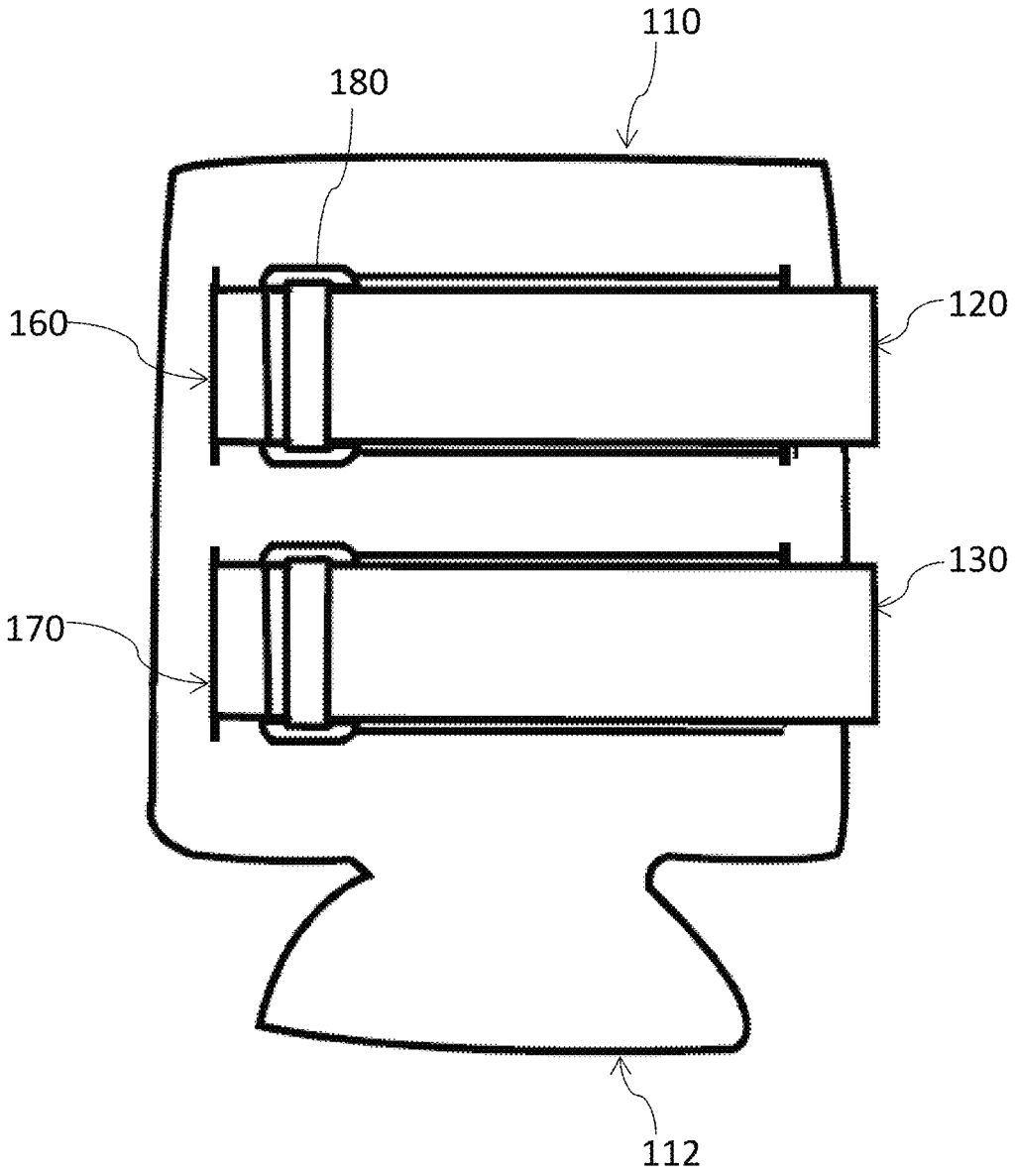
FIG. 2 is a rear view of the mountable holder, according to an exemplary embodiment of the present invention.

Referring to FIGS. 1 and 2 which are the front and rear views of the disclosed mountable holder 100. The mountable holder includes a sleeve 110. The sleeve 110 has surrounding walls, an open bottom, and an open top. A container can be received into the sleeve through the open top. A strap 112 at the bottom of the surrounding walls extends across the open bottom and holds the container. The strap 112 at its opposite ends can be bonded to the bottom edge of the surrounding wall. For example, strap 112 can be fused, fastened, or sewn with the surrounding wall. The strap 112 instead of a continuous base allows the sleeve to be easily collapsed making it compact for storing and transporting.

The sleeve 110 can be made from any flexible material, such as fabric, polymeric materials, and the like. Preferably, the sleeve can be made from insulative material that decreases the heat exchange rate. For example, in chilly weather, such as during skiing, the mounted holder can be coupled to the ski, and the insulative sleeve can prevent the chilling of the beverage. Similarly, in a warmer climate, such as during trekking, the insulative sleeve can decrease the warming of the chilled beverage.

The sleeve is shown in the drawings as cylindrical for cylindrical containers, however, the sleeve of any other shape is within the scope of the present invention.

The sleeve can have four pairs of slits in the surrounding wall. A strap can pass through these slits. The mountable holder has two straps i.e., an upper strap 120 and a lower strap 130, that go around the sleeve through the slits in the surrounding wall of the sleeve. As shown in FIGS. 1 and 2, showing the front side and the rear side of the sleeve, the first pair of slits 140 is in the upper portion of the front side and the second pair of slits 150 is in the bottom portion of the front side. The first pair of slits is directly below the second pair of slits. Similarly, the rear side of the sleeve has a third pair of slits 160 in the upper portion of the rear side and a fourth pair of slits 170 in the bottom portion of the rear side. The front side and the rear side may be opposite to each other. The pair of slits has two elongated slits that extend vertically along a longitudinal axis of the sleeve. The two elongated slits of a pair of slits are closely spaced and run parallel to each other. The height of the slits can be proportional to the width of the strap that passes through the respective slits.

Each of the two straps includes a proximal end and a distal end. The proximal end can be the leading end of the strap, while the distal end can have a ring 180. The proximal end can go around the sleeve passing through the pair of slits and loop through the ring, such that the strap wraps around the sleeve. The proximal end of the strap upon looping through the ring, can run in the reverse direction and attaches to an outer surface of the wrapped portion of the strap. The strap can be like a Hook and Loop Cinch Strap as known in the art. Pulling the proximal end of the strap through the ring causes the tightening of the strap around the sleeve. The tightened strap secures the container within the sleeve. One side of the strap i.e., the inner side can be plain while the outer side of the strap can have a hook and loop fastener. The inner side of the strap is in contact with the sleeve and could slide over the sleeve. Proximal end portion 190 of the outer side of the strap can have a first member of a hook and loop fastener while the rest of the outer side portion of the strap can have a second member of the hook and loop fastener. The first member can be hooks or loops, while the second member can be loops or hooks respectively of the hook and loop fastener. This allows the proximal end portion 190 to be coupled to the wrapped portion of the strap.

The straps can be integrated into the sleeve, wherein the first strap 120 passes through the upper two pairs of slits on the front and rear sides of the sleeve. The second strap 130 passes through the lower two pairs of slits on the front side and the rear side of the sleeve. The proximal end of the strap first enters through the first slit of the pair of slits and then comes out through the second slit of the pair of slits. The proximal end can then go around the sleeve and pass through another pair of slits before looping through the ring.

To mount the disclosed mountable holder to a supporting structure, such as a ski pole, the proximal end of the first strap of the two straps can be looped around the supporting structure and in a tightened state can be coupled to the wrapped portion of the first strap. The mountable holder having the container can be held in one hand while the proximal end of the strap after looping through the pole can be pulled to tighten the strap around the sleeve and the pole, and in the tightened state can be secured to the wrapped portion of the strap. Similarly, the second strap can be secured to the supporting structure.

Figure 3:
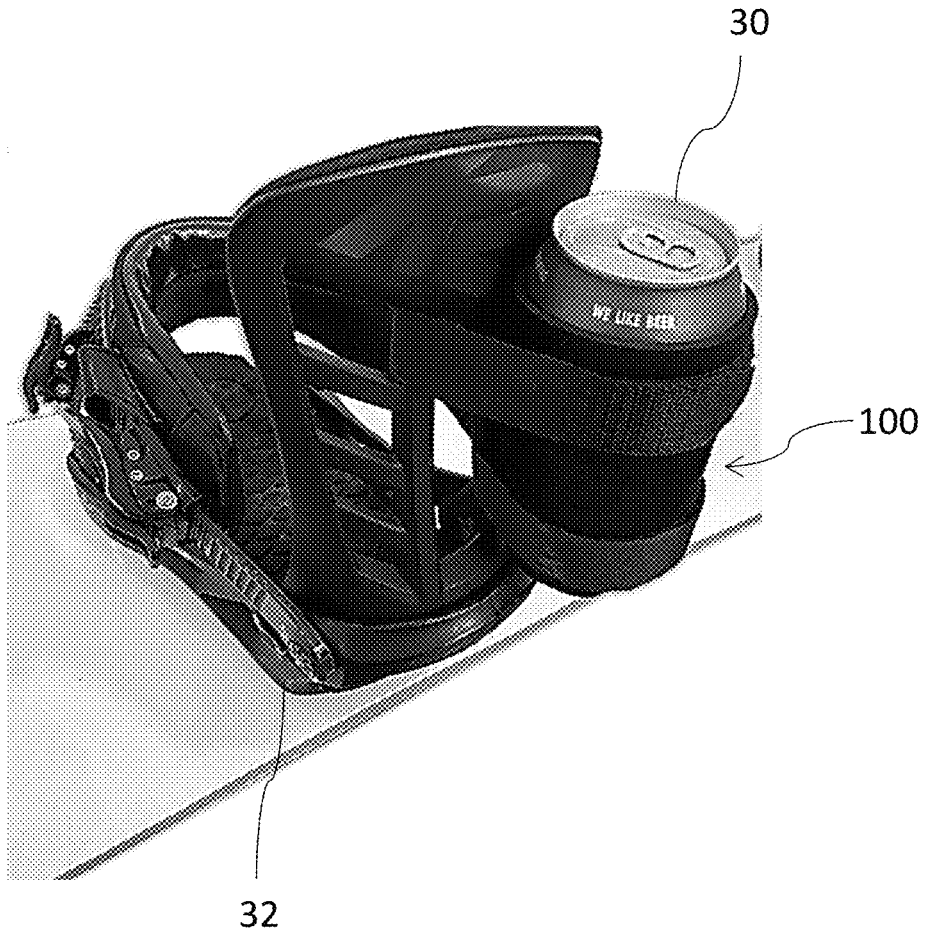
FIG. 3 shows the mountable holder holding a beer can and mounted to a ski pole, according to an exemplary embodiment of the present invention.
Figure 4:
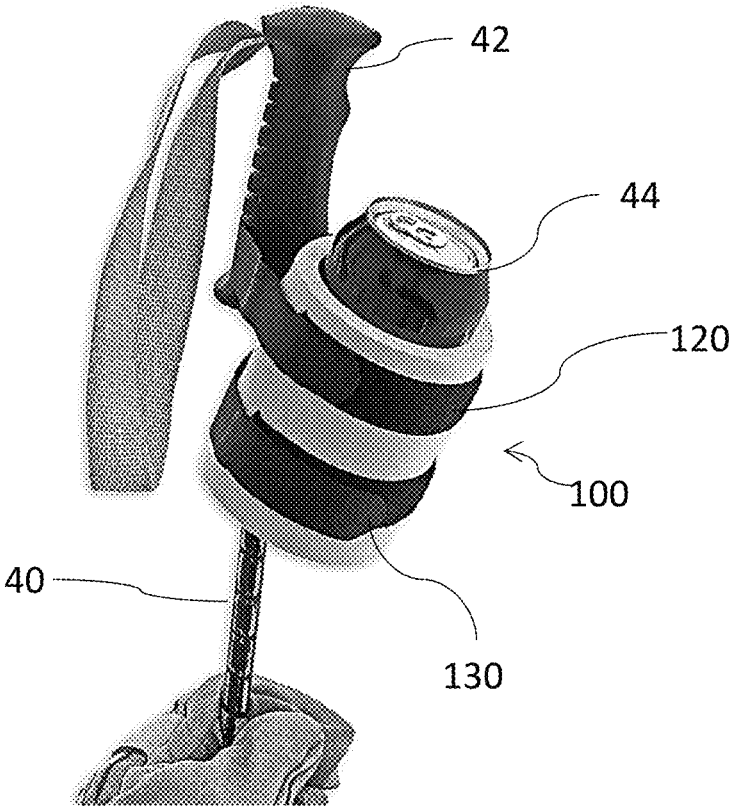
FIG. 4 shows the mountable holder holding a beer can and mounted to a ski shoe, according to an exemplary embodiment of the present invention.

It is understood that the disclosed beverage holder can be used to carry a container that may contain a beverage or any other article. The container can be a can, a bottle, or any similar article. The container can be cylindrical, cuboidal, or of any similar geometry. FIG. 3 shows a beer can 30 in the mountable holder 100 and mounted to ski shoe 32. FIG. 4 shows a beer can 44 in the mountable holder 100 and mounted to a ski pole 40. The upper strap 120 can be secured to handle 42 of the ski pole 40 and the lower strap 130 can be secured to the pole 40.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A mountable holder comprising:

a sleeve having an open top, the sleeve configured to receive a container through the open top;

a first pair of slits in an upper portion of a front side of the sleeve;

a second pair of slits in a lower portion of the front side of the sleeve;

a third pair of slits in an upper portion of a rear side of the sleeve;

a fourth pair of slits in a lower portion of the rear side of the sleeve;

a first strap having a proximal end and a distal end, the distal end has a first ring, the proximal end passes through the first pair of slits, the third pair of slits, and then loop through the first ring; and a second strap having a proximal end and a distal end, the distal end of the second strap has a second ring, the proximal end of the second strap passes through the second pair of slits, the fourth pair of slits, and then loop through the second ring.

2. The mountable holder according to claim 1, wherein each of the first strap and the second strap has an inner side and an outer side, the inner side is plain, a proximal end portion of the outer side has a first member of a hook and loop fastener, and a rest portion of the outer side has a second member of the hook and loop fastener, wherein the first member is configured to couple with the second member.

3. The mountable holder according to claim 1, wherein the sleeve is made from an insulative material.

4. The mountable holder according to claim 2, wherein the sleeve has a surrounding wall and an open bottom, a base strap is coupled at its ends to bottom edges of the surrounding wall.

5. The mountable holder according to claim 1, wherein the sleeve is cylindrical in shape.

6. A method for carrying a beverage container, the method comprising:

providing a mountable holder comprising:

a sleeve having an open top, the sleeve configured to receive the beverage container through the open top, a first pair of slits in an upper portion of a front side of the sleeve, a second pair of slits in a lower portion of the front side of the sleeve, a third pair of slits in an upper portion of a rear side of the sleeve, a fourth pair of slits in a lower portion of the rear side of the sleeve, a first strap having a proximal end and a distal end, the distal end has a first ring, the proximal end passes through the first pair of slits, the third pair of slits, and then loop through the first ring, and a second strap having a proximal end and a distal end, the distal end of the second strap has a second ring, the proximal end of the second strap passes through the second pair of slits, the fourth pair of slits, and then loop through the second ring;

putting the beverage container into the sleeve; and mounting the mountable holder to a supporting structure.

7. The method according to claim 6, wherein each of the first strap and the second strap has an inner side and an outer side, the inner side is plain, a proximal end portion of the outer side has a first member of a hook and loop fastener, and a rest portion of the outer side has a second member of the hook and loop fastener, wherein the first member is configured to couple with the second member.

8. The method according to claim 6, wherein the supporting structure is a ski pole.

9. The method according to claim 6, wherein the supporting structure is a ski shoe.

10. The method according to claim 6, wherein the sleeve is made from an insulative material.

11. The method according to claim 6, wherein the sleeve has a surrounding wall and an open bottom, a base strap is coupled at its ends to bottom edges of the surrounding wall.

12. The method according to claim 6, wherein the sleeve is cylindrical in shape.

* * * * *